US005952607A

United States Patent [19]

Friesen et al.

[11] Patent Number: 5,952,607

[45] Date of Patent: Sep. 14, 1999

[54] LOCAL AREA NETWORK CABLING ARRANGEMENT

[75] Inventors: Harold Wayne Friesen, Dunwoody; David R. Hawkins, Sugar Hill, both of Ga.; Stephen Taylor Zerbs, Gretna, Nebr.

[73] Assignee: Lucent Technologies Inc., Murray Hill, N.J.

[21] Appl. No.: 08/792,609

[22] Filed: Jan. 31, 1997

[51] Int. Cl.[6] ..... H01B 11/02

[52] U.S. Cl. ..... 174/34; 174/27

[58] Field of Search ..... 174/27, 34, 36, 174/113 R, 121 A, 117 A

[56] References Cited

U.S. PATENT DOCUMENTS

| | | | |
|---|---|---|---|
| 3,894,172 | 7/1975 | Jachimowicz et al. | 174/34 |
| 4,058,669 | 11/1977 | Nutt et al. | 174/34 |
| 4,412,094 | 10/1983 | Dougherty et al. | 174/110 F |
| 4,697,051 | 9/1987 | Beggs et al. | 178/63 D |
| 4,873,393 | 10/1989 | Friesen et al. | 174/34 |
| 5,010,210 | 4/1991 | Sidi et al. | 174/34 |
| 5,024,506 | 6/1991 | Hardin et al. | 350/96.23 |
| 5,162,609 | 11/1992 | Adriaenssens et al. | 174/34 |
| 5,424,491 | 6/1995 | Walling et al. | 174/113 R |
| 5,544,270 | 8/1996 | Clark et al. | 385/101 |

*Primary Examiner*—Nestor Ramirez
*Assistant Examiner*—Joseph Waks

[57] ABSTRACT

A cabling media which is suitable for data transmission with relatively low crosstalk includes a plurality of metallic conductors-pairs, each pair including two plastic insulated metallic conductors which are twisted together. The characterization of the twisting is important and relates to parameters such as twist length as well as core strand length/lay. More specifically, particular combinations of twist lengths and core strand length/lay are purposely selected for each insulated pair of the cable in order to achieve performance capabilities that significantly surpass those required under TIA/EIA-568A. In one particular embodiment of this invention, a cable comprises as its transmission media, four twisted pair of individually insulated conductors with each of the insulated conductors including a metallic conductor and an insulation cover which encloses the metallic conductor. The twisting together of the conductors of each pair is characterized as specifically set out herein and the plurality of transmission media are enclosed in a sheath system which in a most simplistic embodiment may be a single jacket made of a plastic material. As a result of the particular twist scheme employed for the conductor pairs, operational performance of the resulting cable is improved. Also, the cable of this invention is relatively easy to connect and is relatively easy to manufacture and install.

21 Claims, 5 Drawing Sheets

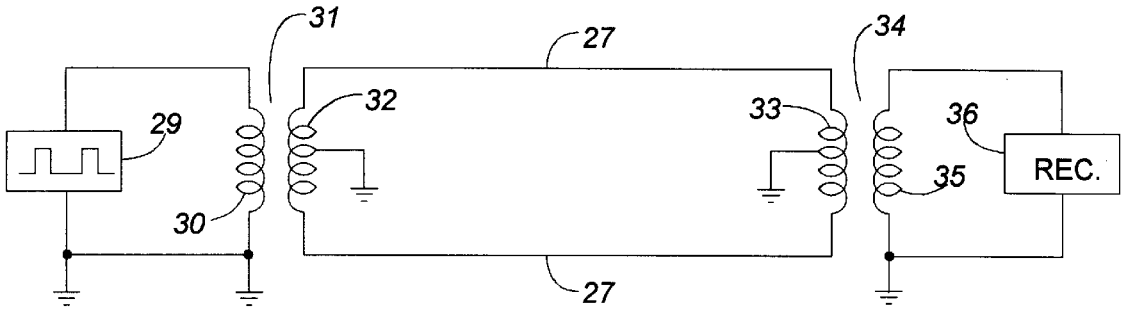
PRIOR ART
FIG. 3
FIG. 5
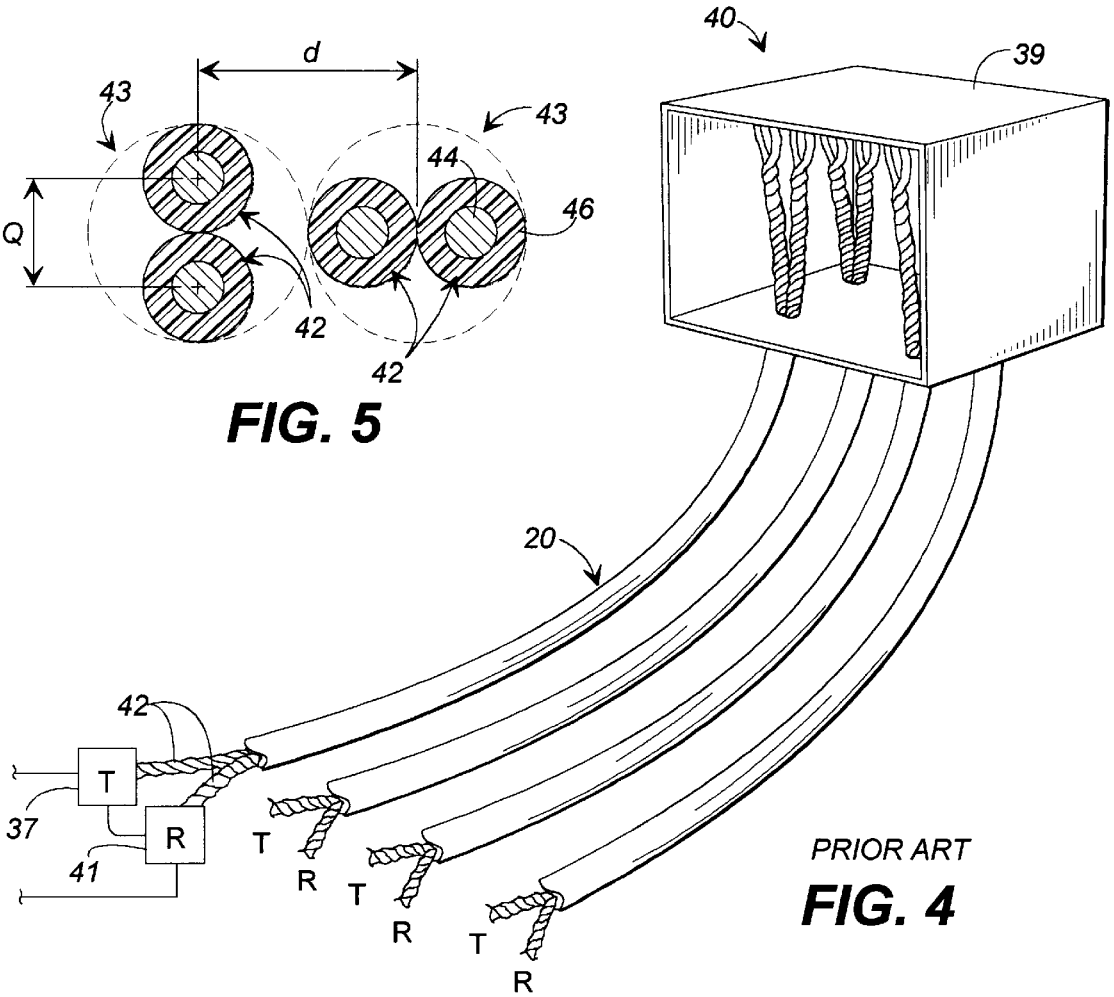
PRIOR ART
FIG. 4

LOCAL AREA NETWORK CABLING ARRANGEMENT

TECHNICAL FIELD

This invention relates to an improved local area network cabling arrangement. More specifically, it relates to a particular cable design which due to its unique construction is capable of providing substantially error-free, high-bit-rate, data transmission while also satisfying numerous elevated operational performance criteria.

BACKGROUND OF THE INVENTION

Along with the greatly increased use of computers for offices and for manufacturing facilities, there has developed a need for a cable which may be used to connect peripheral equipment to mainframe computers and to connect two or more computers into a common network. Of course, given the ever-increasing demands for data transmission, the sought-after cable desirably should not only provide substantially error-free transmission at relatively high rates but also satisfy numerous elevated operational performance criteria. Specifically, the particular cable design of the present invention consistently performs at operational levels which exceed the transmission requirements for cables qualifying as Category 5 cables under TIA/EIA-568A. Among the elevated operational performance criteria that the cable of this invention can reliably and consistently exhibit over existing standards criteria are higher crosstalk margins, i.e. over at least about 10 dB for Near End Crosstalk (NEXT) and over at least about 8 dB for Power Sum Crosstalk (PSUM NEXT), as well as improved Structural Return Loss (SRL) margins, i.e. over at least about 3 dB.

Not surprisingly, of importance to the design of metallic-conductor cables for use in local area networks are the speed and the distances over which data signals must be transmitted. In the past, this need had been one for interconnections operating at data speeds up to 20 kilobits per second and over a distance not exceeding about 150 feet. This need was satisfied with single jacket cables which may comprise a plurality of insulated conductors that were connected directly between a computer, for example, and receiving means such as peripheral equipment. Currently, equipment, generally identified throughout the industry as Category 3 products, is commercially available that can effectively transmit up to 16 MHz data signals and a series of products designated as Category 5 provide the capability of effectively transmitting up to 100 MHz data signals. However, further advances in data rate capability are becoming increasingly difficult because of the amount of crosstalk between the conductor pairs of such commercially available single-jacketed, twisted-pair cables.

Additionally, for both operational and costs reasons, it is important whether or not the system is arranged to provide transmission in what is called a balanced mode. In balanced mode transmission, voltages and currents on the conductors of a pair are equal in amplitude but opposite in polarity. To accomplish this balanced mode transmission, additional components, such as transformers, for example, at end points of the cable between the cable and logic devices may be required, thereby increasing the cost of the system. Oftentimes, computer equipment manufacturers have preferred the use of systems characterized by an unbalanced mode to avoid investing in additional components for each line. At the same time, however, peripheral connection arrangements, specifically the cabling used therein, must meet predetermined attenuation and crosstalk requirements.

As an alternative to a single-jacketed, twisted-pair cable, sometimes the cabling needs of the communications industry have been filled with coaxial cable comprising the well-known center solid and outer tubular conductor separated by a dielectric material. However, coaxial cables, not only inherently provide unbalanced transmission, but also present several other problems. Among other concerns, coaxial connectors are relatively expensive and difficult to install and connect, and, unless they are well designed, installed and maintained, can be the cause of electromagnetic interference.

Given their increasingly stringent objectives, customers, local area network (LAN) vendors and distribution system vendors continue to explore alternatives for making LAN wiring more affordable and manageable while still providing the necessary level of transmission performance. Previously overlooked by some investigators has been the unshielded twisted pair long used for premises distribution of telephone signals.

The unshielded twisted pair has long been used for telephone transmission in the balanced (differential) mode. Used in this manner, the unshielded twisted pair has excellent immunity from interference whether from the outside (EMI) or from signals on other pairs (crosstalk). Another point of concern is that the cable be designed so as not to emit electromagnetic radiation from the cable into the surrounding environment. Over the past several years, in fact, some LAN designers, have come to realize the latent transmission capability of unshielded twisted pair wire. Especially noteworthy is the twisted pair's capability to transmit rugged quantized digital signals as compared to corruptible analog signals. The limitations imposed by crosstalk, especially near-end crosstalk, on the data rate/distance capabilities of twisted pair cables are generally recognized.

In an attempt to enhance the operational performance of twisted pair cables, manufacturers have employed a variety of different twist schemes. As used herein, twist scheme is synonymous with what the industry sometimes calls twinning or pairing. In general, twist scheme refers to the exact length and type/lay of twist selected for each conductor pair. More specifically, in one such twist scheme particularly described in commonly-assigned U.S. Pat. No. 4,873,393 issued in the names of Friesen and Nutt and which is hereby expressly incorporated by reference, it is stated that the twist length for each insulated conductor pair should not exceed the product of about forty and the outer diameter of the insulation of one of the conductors of the pair. While this is just one example of an existing approach for defining a twist scheme which results in an enhanced cable design, many others exist. However, the particular twist scheme set forth and claimed herein is believed to be uniquely different from all existing cable designs with specific technical distinctions discussed in greater detail later.

In addition to controlled pair twist schemes, another treatment for crosstalk is to add shielding over each twisted pair to confine its electric and magnetic fields. However, as the electric and magnetic fields are confined, resistance, capacitance and inductance all change, each in such a way as to increase transmission loss. For instance, it is not unusual to find designs of shielded pairs whose attenuation is three times that of similar unshielded pairs.

Seemingly, the solutions of the prior art to the problem of providing a local area network cabling arrangement which can be used to transmit, for example, data bits error-free at relatively high rates over relatively long distances have not yet been totally satisfying for the ever-increasing demands of the communications industry. What is needed and what is not provided by the prior art is a cable which is inexpensively made and which has operational performance levels which significantly surpass the criteria setting forth present standards for high-performance metallic cables, such as TIA/EIA 568A. In particular, the sought-after cable should exhibit substantially higher crosstalk margins and Structural Return Loss (SRL) margins to handle the ever-increasing transmission rates, i.e. 1.24 gigabits per second. In fact, it is believed that the cable design of the present invention is capable of being used in a Gigabit Ethernet system without the need for special electronics.

SUMMARY OF THE INVENTION

The foregoing problems have been overcome by a cabling arrangement of this invention which is capable of high rate transmission of data streams at a relatively low level of crosstalk. A cabling media which is suitable for data transmission with relatively low crosstalk includes a first pair of metallic conductors, the pair including two plastic insulated metallic conductors which are twisted together. The media also includes at least one other pair of insulated metallic conductors each pair including two plastic insulated metallic conductors which are twisted together and being in relatively close proximity to the first pair. The characterization of the twisting is important and relates to parameters such as twist length as well as core strand length/lay. More specifically, particular combinations of twist lengths and core strand length/lay are purposely selected for-each conductor pair of the cable in order to achieve performance capabilities that significantly surpass those required under TIA/EIA-568A.

In one particular embodiment of this invention, a cable comprises, as its transmission media, four twisted pair of individually insulated conductors with each of the insulated conductors including a metallic conductor and an insulation cover which encloses the metallic conductor. The twisting together of the insulated conductors of each pair is characterized as specifically set out herein and the plurality of transmission media are enclosed in a sheath system which in a most simplistic embodiment may be a single jacket made of a plastic material. Additionally, the cable of the preferred embodiment includes a sheath system which may or may not include a shield to assist in protecting the cable against electromagnetic interference and preventing unwanted electromagnetic emissions or radiations from being generated by the cable.

As a result of the particular twist scheme employed for the insulated conductor pairs, operational performance of the resulting cable is improved. Also, the cable of this invention is relatively easy to connect and is relatively easy to manufacture and install.

BRIEF DESCRIPTION OF THE DRAWING

Other features of the present invention will be more readily understood from the following detailed description of specific embodiments thereof when read in conjunction with the accompanying drawings, in which:

FIG. 3 is a schematic view of a pair of insulated conductors in an arrangement for balanced mode transmission;

FIG. 4 is a view of a data transmission system which includes the cable of this invention;

FIG. 5 is a cross-sectional view of two pairs of insulated conductors as they appear in a cable of this invention;

DETAILED DESCRIPTION

Figure 1B:
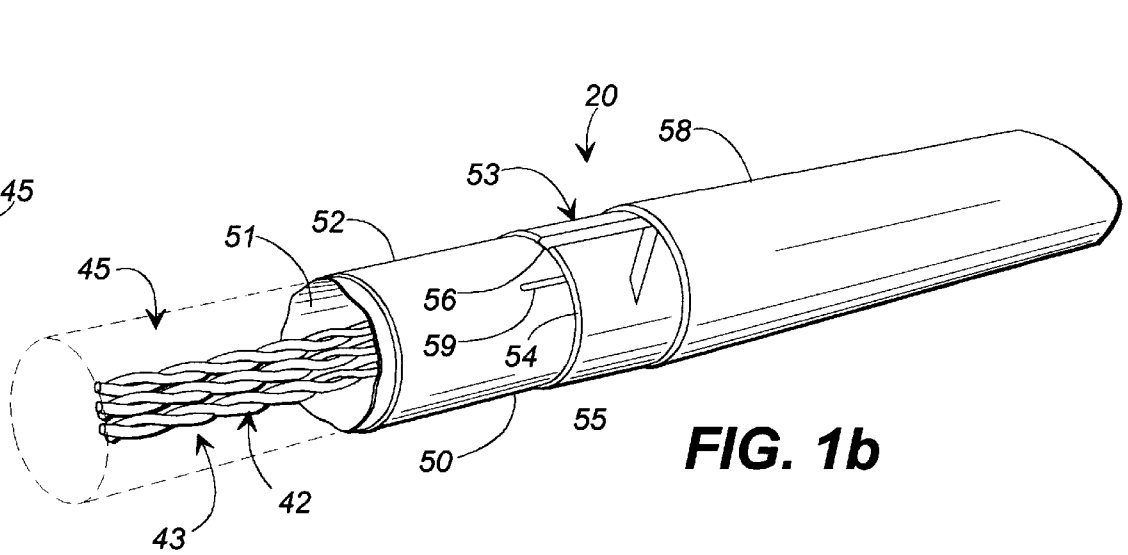
FIGS. 1*a* and 1*b* are perspective views of two embodiments, one shielded and one unshielded, of a cable of this invention for providing substantially error-free data transmission over relatively long distances.
Figure 1A:
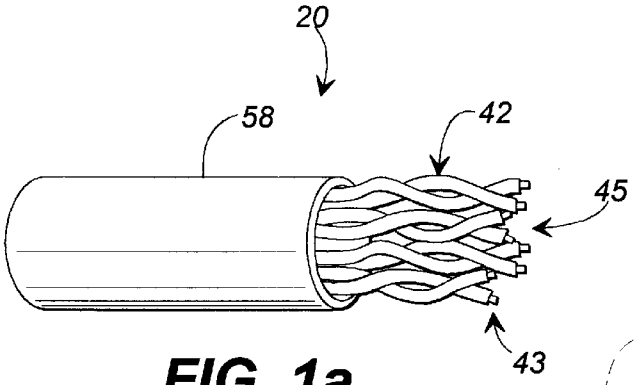

Referring now to FIGS. 1*a* and 1*b*, there are shown two embodiments of a data transmission cable which is designated generally by the numeral 20. Specifically, FIG. 1*a* depicts an unshielded embodiment and FIG. 1*b* depicts a shielded version of the present invention. While the difference between these two embodiments resides in the sheath system, it should be understood that the focus of the present invention is the particular arrangement of the transmission media therein, which is the same for both embodiments.

Figure 2:
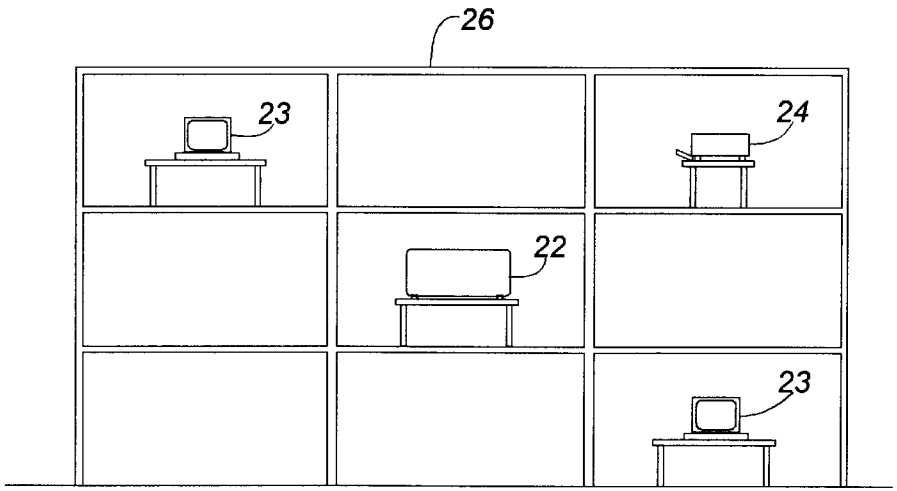
FIG. 2 is an elevational view of a building to show a mainframe computer, personal computers and peripherals linked by the cable of this invention.

Typically, the cable 20 may be used to network one or more mainframe computers 22—22, many personal computers 23—23, and peripheral equipment 24 on the same or different floors of a building 26 (see FIG. 2). The peripheral equipment 24 may include a high speed printer, for example, in addition to any other known and equally suited devices. Desirably, the interconnection system minimizes interference on the system in order to provide substantially error-free transmission.

The cable 20 of this invention is directed to providing substantially error-free data transmission in a balanced mode. More specifically, the particular cable design of the present invention simultaneously elevates a series of operational performance criteria to levels consistently exceeding present industry standards for high-performance metallic-conductor cables. In general, a balanced mode prior art transmission system which includes a plurality of pairs of individually insulated conductors 27—27 is shown in FIG. 3. Each pair of insulated conductors 27—27 is connected from a digital signal source 29 through a primary winding 30 of a transformer 31 to a secondary winding 32 which is center-tap grounded. The conductors are connected to a winding 33 of a transformer 34 at the receiving end which is also center-tap grounded. A winding 35 of the transformer 34 is connected to a receiver 36. With regard to outside interference, whether it be from power induction or other radiated fields, the electric currents cancel out at the output end. If, for example, the system should experience an electromagnetic interference spike, both conductors will be affected equally, resulting in a null, with no change in the received signal. For unbalanced transmission, a shield may minimize these currents but cannot cancel them.

To achieve balanced mode transmission, it is necessary to connect additional components such as transformers into circuit boards at the ends of the connecting cable. Use in an unbalanced mode avoids the need for additional terminus equipment and renders the cable compatible with present equipment. However, because of the distances over which the cable of this invention is capable of transmitting data signals substantially error-free at relatively high rates, there may be a willingness to invest in the additional components at the ends of the cable which are required for balanced mode transmission.

Further, there is a generally-accepted requirement that the outer diameter of the cable 20 not exceed a predetermined value and that the flexibility of the cable be such that it can be installed easily. The cable 20 has a relatively small outer diameter, i.e. in the range of about 0.1 inch to 0.5 inch, and is both rugged and flexible thereby overcoming the many problems encountered when using a cable with individually shielded pairs. The resulting size of the cable depends on a variety of factors including the number conductor pairs used as well the type of sheath system selected. The particular cable of the preferred embodiment of the present invention recites the inclusion of four conductor-pairs within the cable design. However, the cable 20 may, in fact include between two and twenty-five pairs of insulated conductors.

The particular advantages of the present invention over the prior art is attributable to a specific twist length and core strand length/lay used in the cable design disclosed and claimed herein. As used herein, twist length refers to the distance along the length of an insulated conductor pair for a complete revolution of the individual conductors around each other, and core strand length/lay refers to the distance along the length of the cable for the entire core or grouping of multiple conductor-pairs to complete a full revolution. With these definitions in mind, it is important to note that as used herein, the value for the twist length is the measure of the construction as a result of the twisting device used to create the conductor pairs and not as skewed upward or downward by the core strand length/lay which may be employed as the cable is manufactured. While there are many different cable designs with widely varying twist lengths and core strand lengths/lays presently available, each of the designs currently marketed are inferior to the cable of the present invention in at least some of the critical operational performance criteria.

Below is a table that depicts the twist scheme used in the structural makeup of the cable in accordance with the preferred embodiment of the present invention:

| Pair No. | Twist Length (inches) | Minimum Twist Length | Maximum Twist Length | Twists per Foot | Minimum Twists per Foot | Maximum Twists per Foot |
|---|---|---|---|---|---|---|
| 1 | 0.440 | 0.43 | 0.45 | 27.3 | 27 | 28 |
| 2 | 0.410 | 0.40 | 0.42 | 29.3 | 29 | 30 |
| 3 | 0.596 | 0.58 | 0.61 | 20.1 | 19 | 21 |
| 4 | 0.670 | 0.65 | 0.69 | 17.9 | 17 | 19 |

In addition to the particular twist length values set forth above, the present invention combines such twist lengths with a core strand length/lay value between about 4 and 6 inches in the same direction as the twists of the conductor pairs. More specifically, the preferred embodiment of the present invention incorporates a core strand length/lay of about 4.6–4.9 inches in the same direction as the twists rotation of the conductor pairs.

However, beyond the value realized from building a cable in accordance with the particular preferred embodiment of the present invention as specifically quantified above, it should be understood that the present invention also is directed to cables designed using any common multiple of the values specifically quantified herein. In other words, while a particular set of quantified criteria for establishing a preferred twist scheme are presented above, it is further taught and claimed herein that significant operational performance enhancement can be achieved by building a cable with a twist scheme wherein the twist lengths and/or the core strand length/lay are common multiples or factors of any of the values within the ranges disclosed as the preferred embodiment. For example, to select a value within each range of the twists lengths for the conductor pairs, and/or within the range for core strand length/lay, and then multiple these values by a common number to establish a twist scheme would also be deemed to be within the scope of the present invention.

As yet another structural aspect of the present invention that may be considered to further enhance the operation of the resulting cable is the particular positioning of the conductor-pairs relative to one another. More specifically, in accordance with the preferred embodiment, the two twisted pairs with the shortest twist length should be positioned diagonal relative to each other. Therefore, while the crux of this invention is directed at the selection of the most appropriate twist lengths and strand length/lay, further benefits may be recognized if the conductor pairs are optimally positioned relative to each other.

Referring now to FIG. 4, there is shown an example system 40 in which the cable 20 of this invention is useful. In FIG. 4, a transmitting device 37 at one station is connected along a pair of conductors 42—42 of one cable to an interconnect hub 39 and then back out along another cable to a receiving device 41 at another station. A plurality of the stations comprising transmitting devices 37—37 and receiving devices 41—41 are connected to the interconnect hub 39 and then back out along another cable to a receiving device 41 at another station. A plurality of the stations comprising transmitting devices 37—37 and receiving devices 41—41 may be connected to the interconnect hub in what is referred to as a ring network. As can be seen in this example, the conductors are routed from the transmitting device at one terminal to the hub 39 and out to the receiving device at another terminal, thereby doubling the transmission distance.

More particularly, the cable 20 of this invention includes a core 45 comprising a plurality of twisted pairs 43—43 of the individually insulated conductors 42—42 (see FIGS. 1*a*, 1*b* and 5) which are used for data transmission. Each of the insulated conductors 42—42 includes a metallic portion 44 (see FIG. 5) and an insulation cover 46. In a preferred embodiment, the insulation cover 46 may be made of any fluoropolymer material, such as TEFLON, or polyolefin material, such as polyethylene or polypropylene. Furthermore, the outer jacket 58 may be made of a plastic material such as polyvinyl chloride, for example.

It should be noted that the present invention may be used in the design of either a shielded or an unshielded cable. In particular, FIG. 1*a* illustrates an unshielded cable design while FIG. 1*b* depicts a shielded cable design. The difference between the two designs resides only in the sheath system selected for the given application and is not viewed to be the crux of the present invention. However, for completeness, both the shielded and the unshielded embodiments are set forth herein.

In a shielded embodiment, the core 45 is enclosed in a sheath system 50 (see FIG. 1*b*). The sheath system may include a core wrap 51 and an inner jacket 52 which comprises a material having a relatively low dielectric constant. In a preferred embodiment, the polyvinyl chloride (PVC) material. Further, the thickness of the inner jacket is equal to the product of about 0.167 to 1.0 times the outer diameter (DOD) of an insulated conductor 42. For example, if the DOD of the insulated conductor was 0.036, the inner jacket thickness would be about 0.006 to about 0.036.

The inner jacket 52 is enclosed in a laminate 53 (see FIG. 1*b*) comprising a metallic shield 54 and a plastic film 55 and having a longitudinally extending overlapped seam 56. The laminate is arranged so that the plastic film faces outwardly. In a preferred embodiment, the thickness of the metallic shield 54, which typically is made of aluminum, is 0.001 inch whereas the thickness of the film is 0.002 inch. A drain wire 59, which may be a stranded or a solid wire, is disposed between the shield 54 and the inner jacket 52. The metallic shield 54 is enclosed in an outer jacket 58 which comprises a plastic material such as polyvinyl chloride, for example. In a preferred embodiment, the thickness of the outer jacket 58 is about 0.020 inch.

The two embodiments described above, shielded and unshielded, are believed to be the most common form of cabling media to employ the present invention. However, other forms of communication transmission may be within the scope of the present invention. For example, the plurality of pairs may be disposed side by side in a wiring trough and not be enclosed in a plastic jacket as yet another embodiment of the present invention.

Furthermore, the materials for the conductor insulation and/or the jacket(s) may be such as to render the cable flame retardant and smoke suppressive. For example, those materials may be fluoropolymers. Underwriters Laboratories has implemented a testing standard for classifying communications cables based on their ability to withstand exposure to heat, such as from a building fire. Specifically, cables can be either riser or plenum rated. Currently, UL 910 Flame Test is the standard that cables are subjected to prior to receiving a plenum rating. It is intended that the preferred embodiment of the present invention use materials for the jacket and/or conductor insulations such that the cable qualifies for a plenum rating. To achieve such a plenum rating, any number of the known technologies may be incorporated into a cable exhibiting the other specific attributes touted and claimed herein. Even given the aforementioned preference, it should be understood that a cable made in accordance with the present invention does not require such attention to or benefits from the jacketing and insulation material selected. In fact, other particular testing standards may be applied and used to qualify cables incorporating the attributes of the present invention depending on the specific environment into which the cable is going to be placed.

The pairs of insulated conductors 42—42 are adjacent to one another in a cable or in a wiring trough, for example. Therein, the pairs are in close proximity to one another and protection against crosstalk must be provided.

The characterization of the twisting of the conductors of each pair is important for the cable of this invention to provide substantially error-free transmission at relatively high bit rates. Pair twists and pair separation, which is the distance between conductor pairs, are the principal parameters to be controlled. Accordingly, it becomes necessary to measure pair separation and twist separation. Customarily, pair twists have been specified by twist lengths of conductor pairs and twist separation by the difference in twist lengths. Notably, one cable design, particularly described in commonly-assigned U. S. Pat. No. 4,873,393 referenced earlier, it is stated that the twist length for each conductor pair should not exceed the product of about forty and the outer diameter of the insulation of one of the conductors of the pair.

According to the '393 patent, for substantially error-free, high speed data transmission, the conductor pairs that are in close physical proximity should be well separated in twist characteristic as measured by the twist frequency of each pair. As a matter of example and definition, a twist length of 0.5 inches equates to a twist frequency of 2 twists per inch or 24 twists per foot; a twist length of 2 inches equates to a twist frequency of 0.5 twists per inch or 6 twists per foot; and a 5 inch twist length equates to a twist frequency of 0.2 twists per inch or 2.4 twists per foot. In other words, 12 divided by twist length (in inches) equals the number of twist per foot denoting a twist frequency value.

As disclosed in U.S. Pat. No. 4,058,669 which issued in the names of W. G. Nutt and G. H. Webster and herein expressly incorporated by reference, using twist frequency spacing as a design guide, provides a crowding or close spacing of the high twist frequencies but, advantageously, wide spacing of the low twist frequencies.

However, unlike each of the cable designs referenced above where the twist frequency characteristic is a critical concern, the present invention provides a unique cable design whose structural parameters are not only more clearly set forth but which as stated earlier, consistently produce a cable that reliably exceeds a number of the operational performance criteria presently used to qualify and measure high-performance metallic cables.

Twist distortion must be considered and must be reduced to reduce crosstalk. Ideally, a conductor pair that has four twists per foot would forever be a perfect helix having four turns per foot and, if the electromagnetic field alongside this pair were sensed, a sine wave having four cycles per foot would be detected. But when conductor pairs having customary twist lengths are assembled into a core, one pair distorts the other. For instance, if a conductor pair with three twists per foot which is adjacent to one with four twists per foot is examined, spectral components associated with four twists per foot are observed, and, to the extent that they exist, crosstalk is produced as if the adjacent pairs both had four twists per foot. The relatively short twists of this invention resist this type of distortion.

Pair invasion also is an important consideration. The plurality of conductor pairs in the cable of this invention require more cross sectional space than cables made in the past for exchange use in telephone communications. In some existing prior art, seemingly it was most desirable to cause adjacent pairs to mesh together to increase the density or the number of pairs in as little an area as possible. The relatively short twist lengths and the method by which the plurality of conductor pairs are gathered together to form the core 45 minimizes the opportunity for an insulated conductor of one pair to interlock physically or nest with an insulated conductor of an adjacent pair.

Figure 6:
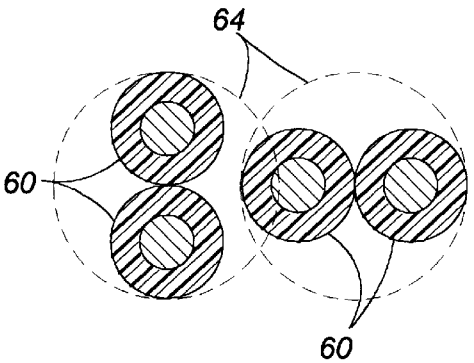
PRIOR ART FIG. 6
FIG. 6 is a cross-sectional view of a pair of insulated conductors in a prior art arrangement.

In order to understand the packing parameter and its effect on crosstalk, attention is directed now to FIGS. 5 and 6 in each of which there is shown a schematic view of two pairs of insulated conductors. The conductors in FIG. 5 have already been referred to hereinbefore and are designated by the numerals 42—42 whereas the conductors shown in FIG. 6 depict a prior art arrangement and are designated 60—60. The conductors of each pair have a center-to-center spacing of a distance "a" and the centers of the pairs spaced apart a distance "d" equal to twice the distance "a". The crosstalk between pairs is proportional to the quantity $a^2/d^2$. Accordingly, the greater the distance "d" between the centers of the conductor pairs, the less the crosstalk.

As can be seen in FIG. 6, which represents some pair prior art cables, it is commonplace in packed cores for at least one individually insulated conductor 60 of one pair to invade the space of another pair as defined by a circumscribing circle 64. On the other hand, compare FIG. 5 in which neither insulated conductor 42 of one pair invades the circle-circumscribed space of another pair. On the average, along the length of conductor pairs associated together in the cable 20, the centers of the pairs will be spaced apart the distance "d". This results in reduced crosstalk.

The short twist length and the method of gathering together the conductor pairs effectively reduces pair meshing and causes each conductor pair to behave as though disposed in and to remain in a cylinder having a diameter of twice the outer diameter of an insulated conductor. Although the pairs of the cable have shared space insofar as electromagnetic fields are concerned, there is little, if any, sharing of the physical spaces defined by the circumscribing circles. As a result, the transmission loss between pairs is maintained at a low level and crosstalk between pairs is acceptable.

The absence of individual pair shielding overcomes another objection to prior art cables. The outer diameter of the insulation cover 46 about each metallic conductor is small enough so that the insulated conductor can be terminated with standard connector hardware.

The cable of this invention also is advantageous from the standpoint of the number of colors required for identifying the insulated conductors. Generally, with the longer twist lengths, when the sheath system is removed from an end portion of a cable, conductors of the twisted pairs intermix. For example, a white colored insulated conductor of a blue-white pair may mix with a green insulated conductor of a green-white pair. As a result, a larger number of color combinations must be used and hence inventoried to insure that proper identification can be made upon removal of a portion of the sheath system. Longer twist pairs are subject to untwisting at splices which can result in a type of splicing error called split pairs in which a wire of one pair is mistaken for that of another pair and two pairs thereby become useless.

On the other hand, with the cable of this invention, the short twist lengths cause the twist to be maintained in the pairs even after the sheath system is removed. As a result, the numbers of colors that need be used is reduced significantly. Additionally, due to the fact that the individual conductors of such tight pairs are less likely to separate, there are significantly fewer connector errors that occur during use of these cables.

Figure 7A:
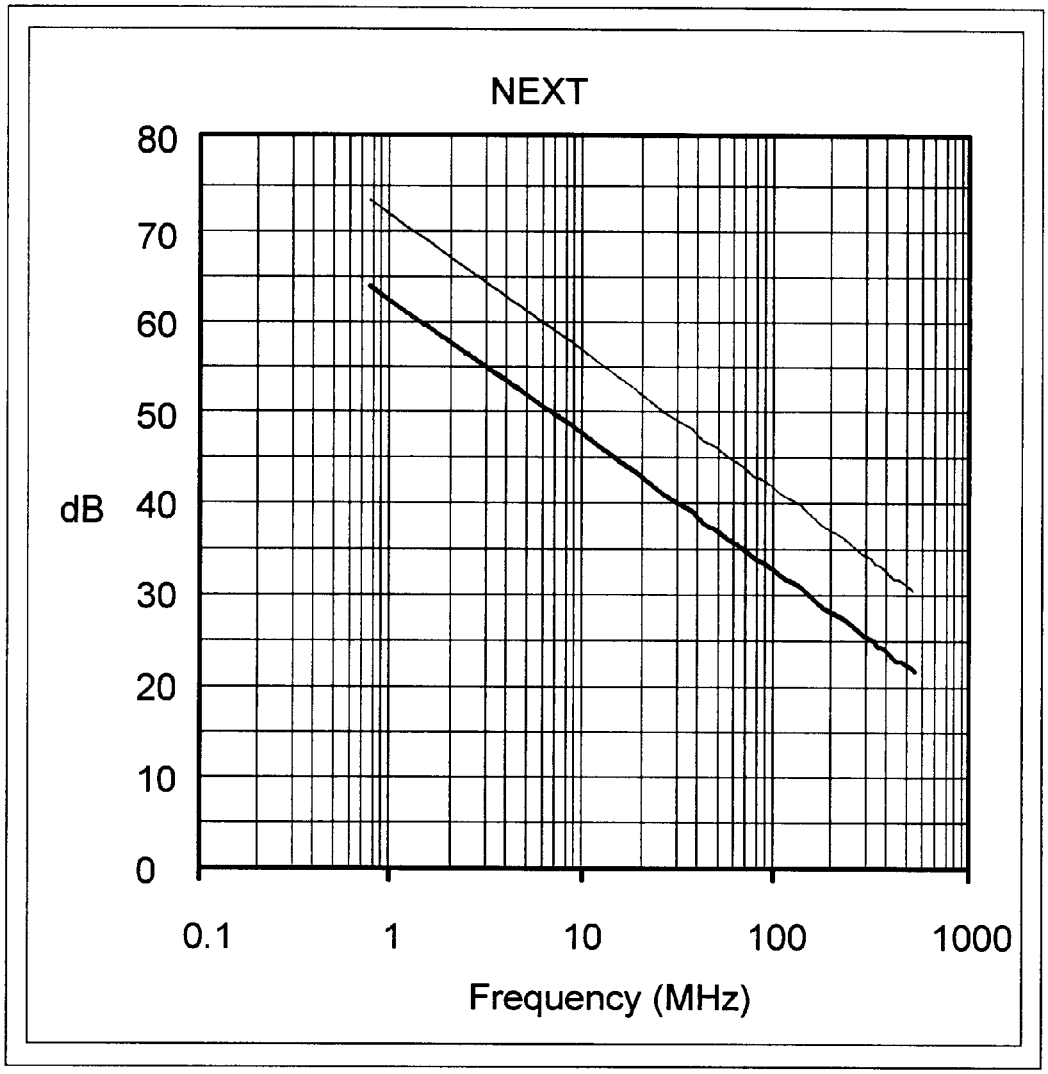
FIGS. 7*a*–7*c* graphically depict the relationship of certain operational performance criteria versus frequency for a cable satisfying existing standards and of a cable of this invention.
Figure 7B:
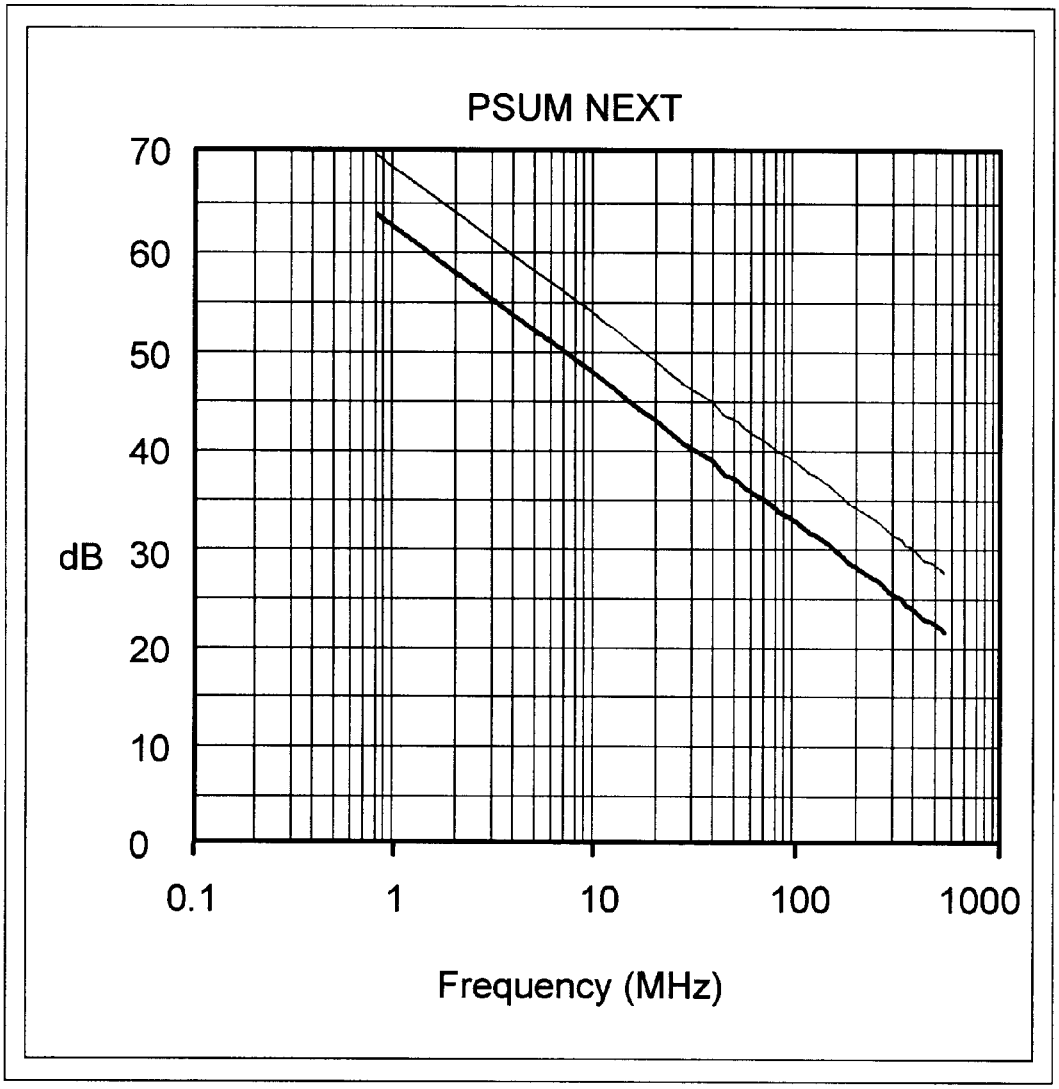
Figure 7C:
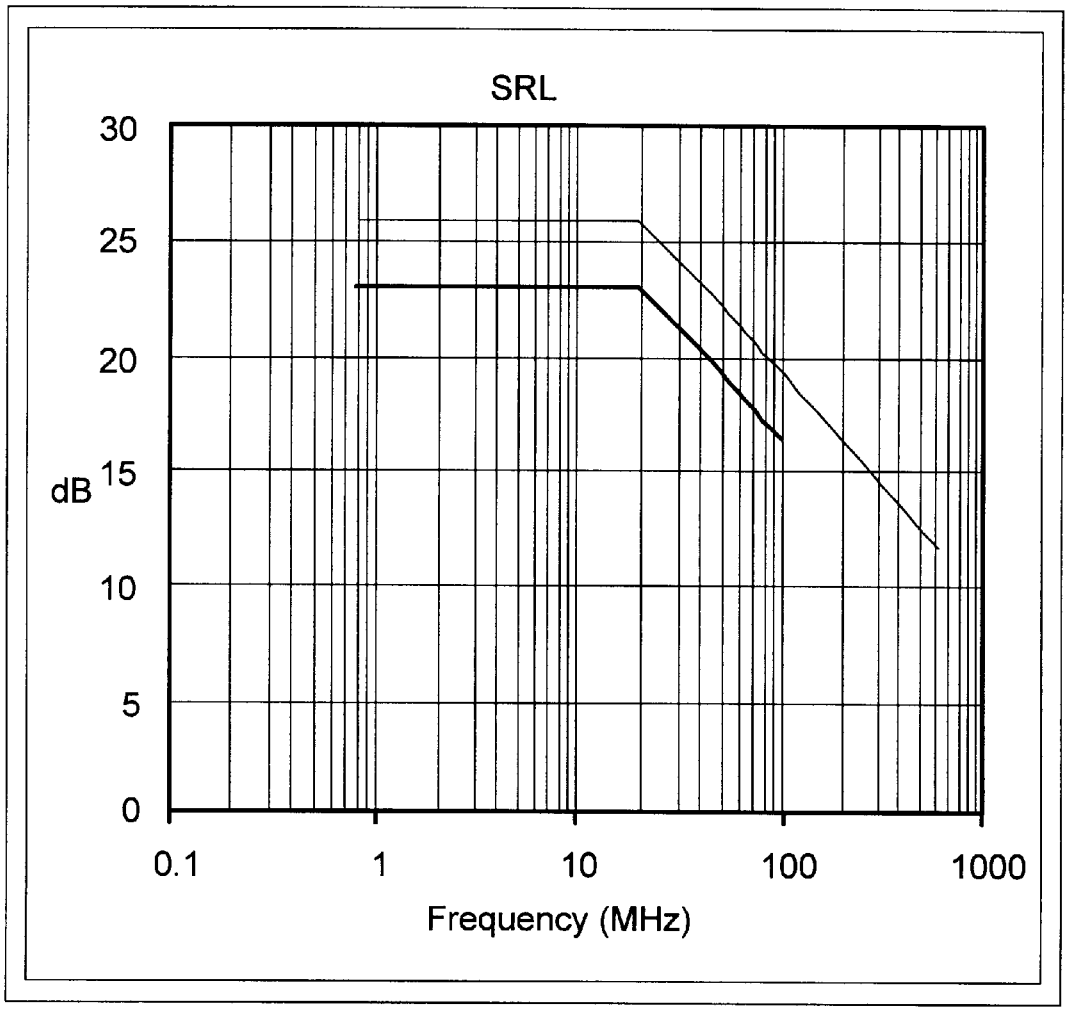

Now to more specifically address the operational performance of the present invention as compared to the industry accepted standards for high-performance metallic cables, attention is drawn to FIGS. 7*a*–7*c*. Each of these Figures graphically depict how cables manufactured in accordance with the present invention test out relative to the values presently used to qualify Category 5 cables under TIA/EIA 568A. In particular, FIG. 7*a* illustrates the relative values for crosstalk, specifically Near End Crosstalk (NEXT), FIG. 7*b* illustrates the relative values for Power Sum Crosstalk (PSUM NEXT), while FIG. 7*c* illustrates the relative values for Structural Return Loss (SRL). Each of the operational performance values, namely NEXT, PSUM NEXT, and SRL, are measured in dB as it varies with frequency shown as logarithmic scale of MHz. While the specific operational performance values depicted adequately show the ability of cables of the present invention to exceed presently governing standards, it should be noted that the calculations were based on very conservative test results that would insure a cable with operational capabilities that could reliably and consistently be reproduced even in light of the inherent manufacturing and measuring tolerances that exist. Furthermore, as a matter of clarity, it is to be understood that as shown herein, the bottom or lowermost line represents the present values as defined by the above-identified standard while the top or uppermost line represents a most conservative gauge of the performance of a cable manufactured in accordance with the present invention.

FIG. 7*a* presents that over the frequency range of about 0.75 MHz to about 500 MHz, the most conservative calculations of cables made in accordance with the present invention exceed the existing standards for Near End Crosstalk (NEXT) by at least 10 dB. Likewise, FIG. 7*b* represents that over a similar frequency range, conservative calculations and measurements of the cables as claimed herein offer at least an 8 dB improvement over the standards values with regard to Power Sum Crosstalk (PSUM NEXT). Lastly, FIG. 7*c* documents at least a 3 dB enhancement over present standards levels for Structural Return Loss (SRL) up to 100 MHz, which is where present standards values stop, even though the SRL values for the present invention are projected out to about 500 MHz. However, even beyond the particular values identified above and depicted in the associated Figures, it is anticipated that the cable design of the present invention may typically produce a cable which exceeds the standards levels by at least about 15 dB for NEXT, by at least about 13 dB for PSUM NEXT and by at least about 7.5 dB for SRL.

In addition to the specific twist scheme factors discussed above, a number of other factors must also be considered to arrive at a cable design which is readily marketable for such uses. The jacket of the resulting cable should exhibit low friction to enhance the pulling of the cable into ducts or over supports. Also, the cable should be strong, flexible and crush-resistant, and it should be conveniently packaged and not unduly weighty. Because the cable may be used in occupied building spaces, flame retardance also is important.

The data transmission cable should be low in cost. It must be capable of being installed economically and be efficient in terms of space required. It is not uncommon for installation costs of cables in buildings, which are used for interconnection, to outweigh the cable material costs. Building cables should have a relatively small cross-section inasmuch as small cables not only enhance installation but are easier to conceal, require less space in ducts and troughs and wiring closets and reduce the size of associated connector hardware.

Cable connector ability is very important and is more readily accomplished with twisted insulated conductor pairs than with any other medium. A widely used connector for insulated conductors is one which is referred to as a split beam connector. Desirably, the outer diameter of insulated conductors of the sought-after cable is sufficiently small so that the conductors can be terminated with such existing connector systems.

Further, any arrangement proposed as a solution to the problem should be one which does not occupy an undue amount of space and one which facilitates a simplistic connection arrangement. There is a need to provide cables that can transmit data rates of up to gigabits per second, error-free, from stations to closets or between computer cabinets separated by comparable distances to main rooms, be readily installed, fit easily into building architectures, and be safe and durable.

It should be understood that the above-described arrangements are simply illustrative of the invention. Other arrangements may be devised by those skilled in the art which will embody the principles of the invention and fall within the scope and spirit thereof.

What is claimed is:

1. A cabling media comprising:

a plurality of pairs of conductors, each of said pairs including two metallic conductors each separately surrounded by an insulation and which along essentially the entire length of the cable are twisted together in accordance with a twist scheme selected from the group consisting of 1) a first pair having a twist length between about 0.43 and about 0.45 inches; a second pair having a twist length between about 0.40 and about 0.42 inches; a third pair having a twist length between about 0.58 and about 0.61 inches; and a forth pair having a twist length between about 0.65 and about 0.69 inches; and 2) at least four pairs with each of the pairs having individual twist lengths equal to a common multiple of values within one of the specific ranges listed immediately above and wherein the range multiplied for each of the at least four pairs is a different specified range than that of any of the other at least four pairs;

wherein a conductor-pair within each of the specified ranges is adjacent to at least one of the conductor-pairs from one of the other specified ranges; and a jacket which encloses the plurality of pairs of insulated metallic conductors.

2. The cabling media of claim 1 further has a core strand length of between about 4 and 6 inches.

3. The cabling media of claim 2 wherein the core strand length is about 4.6–4.9 inches.

4. The cabling media of claim 1 wherein there are four pair of said metallic conductors.

5. The cabling media of claim 4 wherein two of the twisted pairs with the two shortest twist lengths are positioned diagonal relative to each other.

6. The cabling media of claim 1 wherein the metallic conductors are 24 AWG.

7. The cabling media of claim 1 wherein the jacket is made of a material with flame retardant and smoke suppression properties.

8. The cabling media of claim 1 wherein the insulation of the metallic conductors is made of a material with flame retardant and smoke suppression properties.

9. The cabling media of claim 1 wherein the jacket and conductor insulation exhibit flame retardant and smoke suppression properties which are sufficient to allow the cable to pass the criteria of the UL 910 Flame Test.

10. A cabling media comprising:

a plurality of pairs of conductors, each of said pairs including two metallic conductors each separately surrounded by an insulation and which along essentially the entire length of the cable are twisted together in accordance with a twist scheme selected from the group consisting of 1) a first pair having between about 17 and 19 twists per foot; a second pair having between about 19 and 21 twists per foot; a third pair having between about 27 and 28 twists per foot; and a forth pair having between about 29 and 30 twists per foot; and 2) at least four pairs with each of the pairs having individual twist per foot values equal to a common multiple of values within one of the specific ranges listed immediately above and wherein the range multiplied for each of the at least four pairs is a different specified range than that of any of the other at least four pairs;

wherein a conductor-pair within each of the specified ranges is adjacent to at least one of the conductor-pairs from one of the other specified ranges; and a jacket which encloses the plurality of pairs of insulated metallic conductors.

11. The cabling media of claim 10 further has a core strand length of between about 4 and 6 inches.

12. The cabling media of claim 11 wherein the core strand length is about 4.6–4.9 inches.

13. The cabling media of claim 10 wherein there are four pair of said metallic conductors.

14. The cabling media of claim 13 wherein two of the twisted pairs with the two shortest twist lengths are positioned diagonal relative to each other.

15. The cabling media of claim 10 wherein the metallic conductors are 24 AWG.

16. The cabling media of claim 10 wherein the jacket is made of a material with flame retardant and smoke suppression properties.

17. The cabling media of claim 10 wherein the insulation of the metallic conductors is made of a material with flame retardant and smoke suppression properties.

18. The cabling media of claim 10 the jacket and conductor insulation exhibit flame retardant and smoke suppression properties which are sufficient to allow the cable to pass the criteria of the UL 910 Flame Test.

19. A carrier of communication signals comprising:

a plurality of pairs of conductors, each of said pairs including two metallic conductors each separately surrounded by an insulation and which along essentially the entire length of the cable are twisted together in accordance with a twist scheme selected from the group consisting of 1) a first pair having between about 17 and 19 twists per foot; a second pair having between about 19 and 21 twists per foot; a third pair having between about 27 and 28 twists per foot; and a forth pair having between about 29 and 30 twists per foot; and 2) at least four pairs with each of the pairs having individual twist lengths equal to a common multiple of values within one of the specific ranges listed immediately above and wherein the range multiplied for each of the at least four pairs is a different specified range than that of any of the other at least four pairs;

wherein a conductor-pair within each of the specified ranges is adjacent to at least one of the conductor-pairs from one of the other specified ranges; and a trough which supports the plurality of pairs of insulated metallic conductors.

20. The communication signals carrier of claim 19 further having a core strand length/lay of about 4.6–4.9 inches.

21. A local area network comprising:

at least first and second communication devices connected together such that communication signals are transportable between these devices by a plurality of pairs of conductors, each of said pairs including two metallic conductors each separately surrounded by an insulation and which along essentially the entire length of the cable are twisted together in accordance with a twist scheme selected from the group consisting of 1) a first pair having between about 17 and 19 twists per foot; a second pair having between about 19 and 21 twists per foot; a third pair having between about 27 and 28 twists per foot; and a forth pair having between about 29 and 30 twists per foot; and 2) at least four pairs with each of the pairs having individual twist lengths equal to a common multiple of values within one of the specific ranges listed immediately above and wherein the range multiplied foe each of the at least four pairs is a different specified range than that of any of the other at least four pairs;

wherein a conductor-pair within each of the specified ranges in adjacent to at least one of the conductor-pairs from one of the other specified ranges.

* * * * *